US006519804B1

(12) United States Patent
Vujik

(10) Patent No.: US 6,519,804 B1
(45) Date of Patent: Feb. 18, 2003

(54) VACUUM CLEANER WITH RELEASABLE DIRT AND DUST SEPARATING APPARATUS

(75) Inventor: Remco Douwinus Vujik, Bath (GB)

(73) Assignee: Dyson Limited, Wiltshire (GB)

( * ) Notice: Subject to any disclaimer, the term of this patent is extended or adjusted under 35 U.S.C. 154(b) by 0 days.

(21) Appl. No.: 09/868,487

(22) PCT Filed: Dec. 6, 1999

(86) PCT No.: PCT/GB99/04086

§ 371 (c)(1),
(2), (4) Date: Jun. 18, 2001

(87) PCT Pub. No.: WO00/36963

PCT Pub. Date: Jun. 29, 2000

(30) Foreign Application Priority Data

Dec. 18, 1998 (GB) ..... 9827756

(51) Int. Cl.[7] ..... A47L 9/16

(52) U.S. Cl. ..... 15/331; 15/334; 15/340.3; 15/353

(58) Field of Search ..... 15/319, 331, 332, 15/337, 334, 340.3, 353

(56) References Cited

U.S. PATENT DOCUMENTS

| | | | | |
|---|---|---|---|---|
| 2,487,443 A | * | 11/1949 | Hough | 15/332 |
| 5,109,566 A | | 5/1992 | Kobayashi et al. | 15/319 |
| 5,467,502 A | * | 11/1995 | Johnson et al. | 15/332 |
| 5,477,586 A | | 12/1995 | Jacobs et al. | 15/332 |
| 5,504,970 A | * | 4/1996 | Neshat et al. | 15/334 |
| 5,781,960 A | | 7/1998 | Kilström et al. | 15/319 |
| 6,317,920 B1 | * | 11/2001 | Brickner et al. | 15/334 |

FOREIGN PATENT DOCUMENTS

| | | |
|---|---|---|
| EP | 0 134 654 A1 | 3/1985 |
| GB | 2 134 377 A | 8/1984 |
| GB | 2321181 A | 7/1988 |
| GB | 2 325 850 A | 12/1998 |

* cited by examiner

*Primary Examiner*—Theresa T. Snider
(74) *Attorney, Agent, or Firm*—Morrison & Foerster LLP

(57) ABSTRACT

The invention provides a vacuum cleaner (10) comprising dirt and dust separating apparatus (52) for separating dirt and dust from an airflow and having an inlet (59), and a cleaner head (22) having an outlet (32) communicating with the inlet (59) of the dirt and dust separating apparatus (52). The dirt and dust separating apparatus (52), or a part (58) thereof incorporating the inlet (59), is movable into an alternative position in which the outlet (32) of the cleaner head (22) is not in communication with the inlet (59) of the dirt and dust separating apparatus (52) and in which an alternative dirty air inlet (100) may be connected to the inlet (59) of the dirt and dust separating apparatus (52) characterized in that the inlet (59) of the dirt and dust separating apparatus (52) is adapted to cooperate releasably with the outlet (32) of the cleaner head (22). This arrangement allows a hose (100), or a hose and wand assembly, to be attached directly to the inlet (59) to the dirt and dust separating apparatus (52). When the cleaner head (22) is in use, the incoming air is not required to travel through the hose (100) or any other ducting designed to carry air from the hose (100). In each case, the airflow path is kept to an absolute minimum. Furthermore, there is no changeover valve involved which reduces the risk of malfunction or failure in this area and also avoids the need for the incoming air to pass through a discontinuity in the airflow path of the cleaner (10).

20 Claims, 8 Drawing Sheets

FIG.6a.
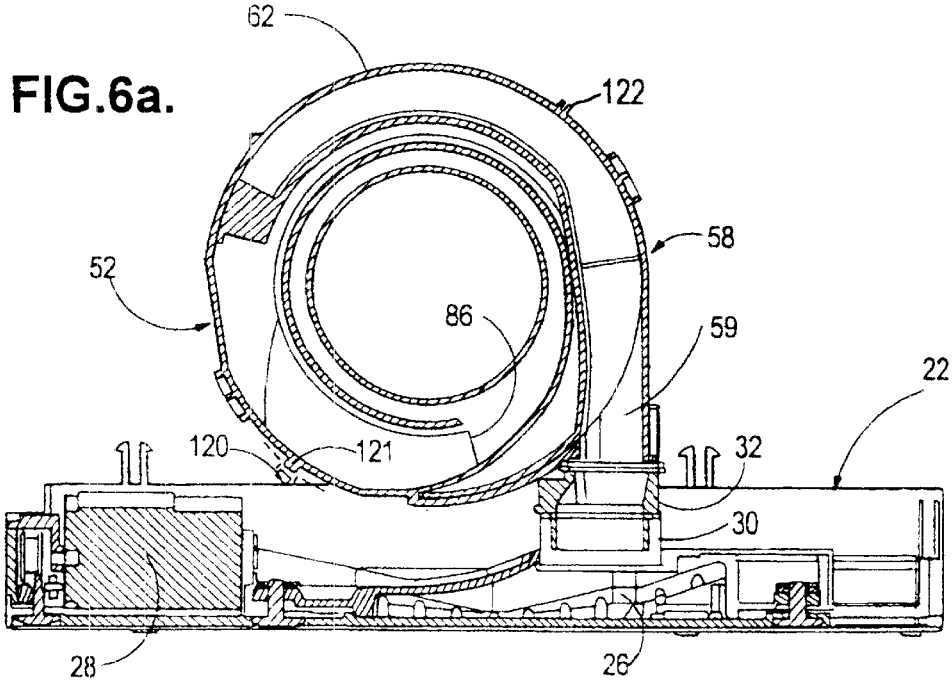
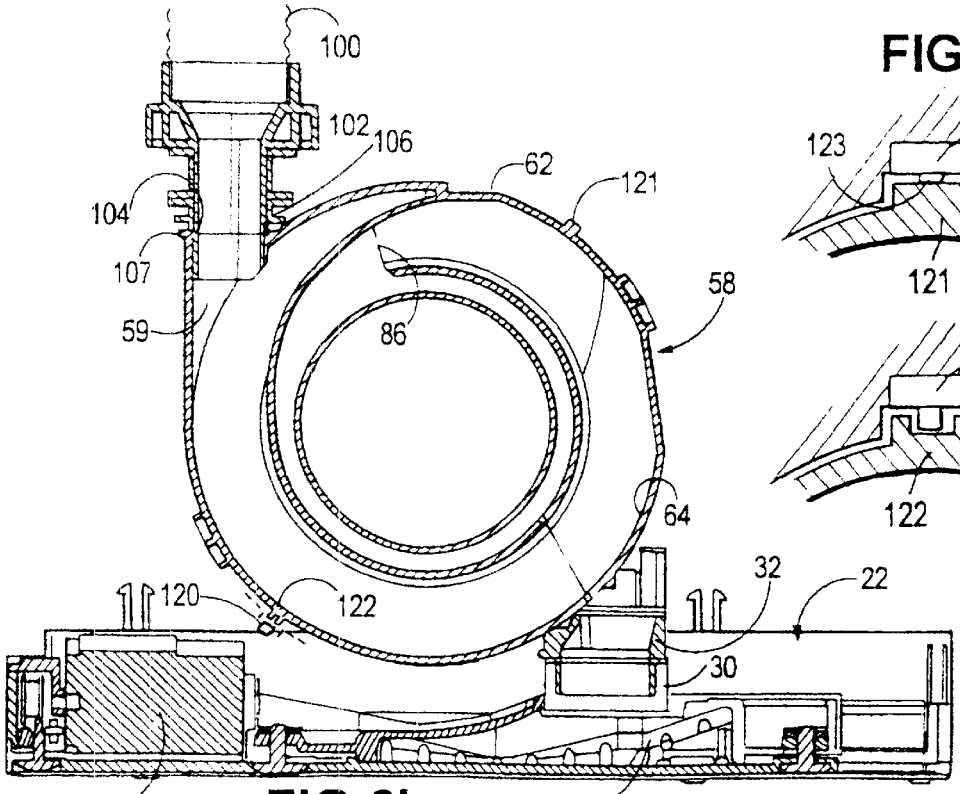
FIG.6b.
FIG.6c.
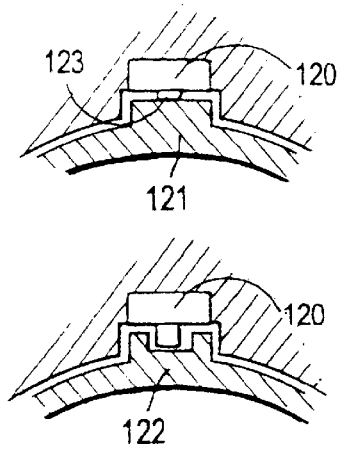

VACUUM CLEANER WITH RELEASABLE DIRT AND DUST SEPARATING APPARATUS

FIELD OF THE INVENTION

The invention relates to a vacuum cleaner particularly, but not exclusively, to a robotic vacuum cleaner.

BACKGROUND OF THE INVENTION

Vacuum cleaners operable in more than one mode, i.e., in upright mode and in cylinder mode, are well known. In the upright mode, the cleaner operates by drawing dirty air into the cleaner by way of a cleaner head which travels across the floor or other surface to be cleaned. In the cylinder mode, the dirty air is drawn into the cleaner via a hose or a hose and wand assembly. Most cleaners which are convertible between the two modes of operation are essentially upright cleaners which have permanently attached hoses which can be brought into operation when cylinder cleaning is required. In some cases, the hose is permanently connected to the inlet of the dirt and dust separating apparatus of the cleaner and the distal end of the hose is then stored in a hollow socket during upright cleaning so that the hose becomes part of the dirty air inlet path during upright cleaning. Such an arrangement results in losses which are higher than is desirable during upright cleaning due to the passage of the air through a hose rather than through a smooth conduit or pipe. In other arrangements, the hose is permanently connected to the main body of the cleaner but a valve is used to select whether dirty air is drawn into the cleaner through the cleaner head or through the hose. The operation of the valve can be made dependent upon the angle of inclination of the main body of the upright cleaner as illustrated and described in EP 0 134 654 B. This type of arrangement is better than the aforementioned alternative arrangement during upright cleaning because the dirty air is not required to pass through a hose. However, in such an arrangement, the airflow passage is often longer than is desirable during cylinder cleaning and, as a result, avoidable losses can occur.

Autonomous or robotic vacuum cleaners have also been proposed. Robotic vacuum cleaners operate in a manner which is different to that of both upright and cylinder cleaners. In the normal or autonomous mode of operation, the cleaner traverses the surface to be cleaned under its own power and using its own navigation system so that human intervention is not required. Dirty air is drawn into the machine through a cleaner head in a manner similar to that used in upright cleaning using an upright cleaner. Robotic vacuum cleaners are shown and described in, inter alia, U.S. Pat. No. 5,781,960 and U.S. Pat. No. 5,109,566. The latter of these documents also indicates that a hose can be attached to the robotic vacuum cleaner for the purpose of attaching a conventional suction hose for manual cleaning of areas which cannot be reached by the robotic cleaner. As in conventional vacuum cleaners, a device for changing the air path so as to select the dirty air inlet for the desired mode of operation is included. Such changeover devices are inevitably prone to failure on occasion and normally cause a discontinuity in the airflow paths in which they are placed. This can lead to frictional losses and/or pressure drops within the relevant cleaner.

SUMMARY OF THE INVENTION

It is an object of the present invention to provide a vacuum cleaner which is convertible between two different modes of operation easily and conveniently. It is a further object of the present invention to provide a vacuum cleaner which is convertible between two different modes of operation in a manner which avoids unnecessary losses or in which unnecessary losses are minimised.

An aspect of the invention provides a vacuum cleaner comprising a chassis for releasably supporting a dirt and dust separating apparatus for separating dirt and dust from an airflow, and a cleaner head having an outlet communicating releasably with an inlet of the dirt and dust separating apparatus, the dirt and dust separating apparatus being releasable from the chassis to allow the dirt and dust separating apparatus, or a part thereof incorporating the inlet to move into an alternative position in which the outlet of the cleaner head is not in communication with the inlet of the dirt and dust separating apparatus and in which an alternative dirty air inlet may be connected to the inlet of the dirt and dust separating apparatus.

This arrangement allows a hose, or a hose and wand assembly, to be attached directly to the inlet to the dirt and dust separating apparatus without forcing the incoming air which then enters via the hose to travel through the ducting designed to carry dirty air from the cleaner head. When the cleaner head is in use, the incoming air is not forced to travel through the hose or any other ducting designed to carry air from the hose. In each case, the airflow path is kept to an absolute minimum. Furthermore, there is no changeover valve involved which us the risk of malfunction or failure in this area and also avoids the need for the incoming air to pass through a discontinuity in the airflow path of the cleaner.

In a preferred embodiment, the dirt and dust separating apparatus comprises, or is surrounded by, a rigid shell or housing. This makes the movement of the apparatus, or the relevant part thereof, easier and more manageable for the user. More preferably, the dirt and dust separating apparatus is generally cylindrical, with one end portion being attachable to a main body in more than one position relative thereto, advantageously in two diametrically opposed positions. The diametric opposition of the two said positions is advantageous because the risk of the wrong position being inadvertently selected by the user is minimised. Other spacings of the two said positions are possible, a spacing of 90° being advantageous as well. As an alternative to removing the part of the separating apparatus incorporating the inlet and reattaching it in a new position, the part of the separating apparatus incorporating the inlet can be rotatable with respect to the remainder of the separating apparatus. Suitable indicia or physical formations can be used to mark the positions between which the part of the separating apparatus incorporating the inlet should be rotated It is preferred that the dirt and dust separating apparatus comprises a centrifugal separator, more preferably two cyclones arranged in series. Such an arrangement provides efficient and effective separation of dirt and dust from the airflow.

Preferably the vacuum cleaner comprises means for sensing the position of the dirt and dust separating apparatus, or the part incorporating the inlet, and for controlling operation of the cleaner according to the sensed position. When the cleaner is an autonomous cleaner which is capable of autonomously moving across an area, the sensed position of the inlet can control whether the cleaner operates in an autonomous mode or a manual mode.

Preferably, when the sensing means senses that the outlet of the cleaner head is not in communication with the inlet of the dirt and dust separating apparatus, operation of the brush bar of the cleaner is inhibited.

BRIEF DESCRIPTION OF THE DRAWINGS

An embodiment of the invention will now be described, by way of example only, with reference to the accompanying drawings, wherein:

FIGS. 6*a* and 6*b* are similar transverse sectional views to FIGS. 4*a* and 4*b* showing an alternative form of sensing the position of the inlet to that shown in FIGS. 4*a* and 4*b;*

FIG. 6*c* is a more detailed view of the sensing arrangement shown in FIGS. 6*a* and 6*b;*

DETAILED DESCRIPTION OF THE INVENTION

Figure 1:
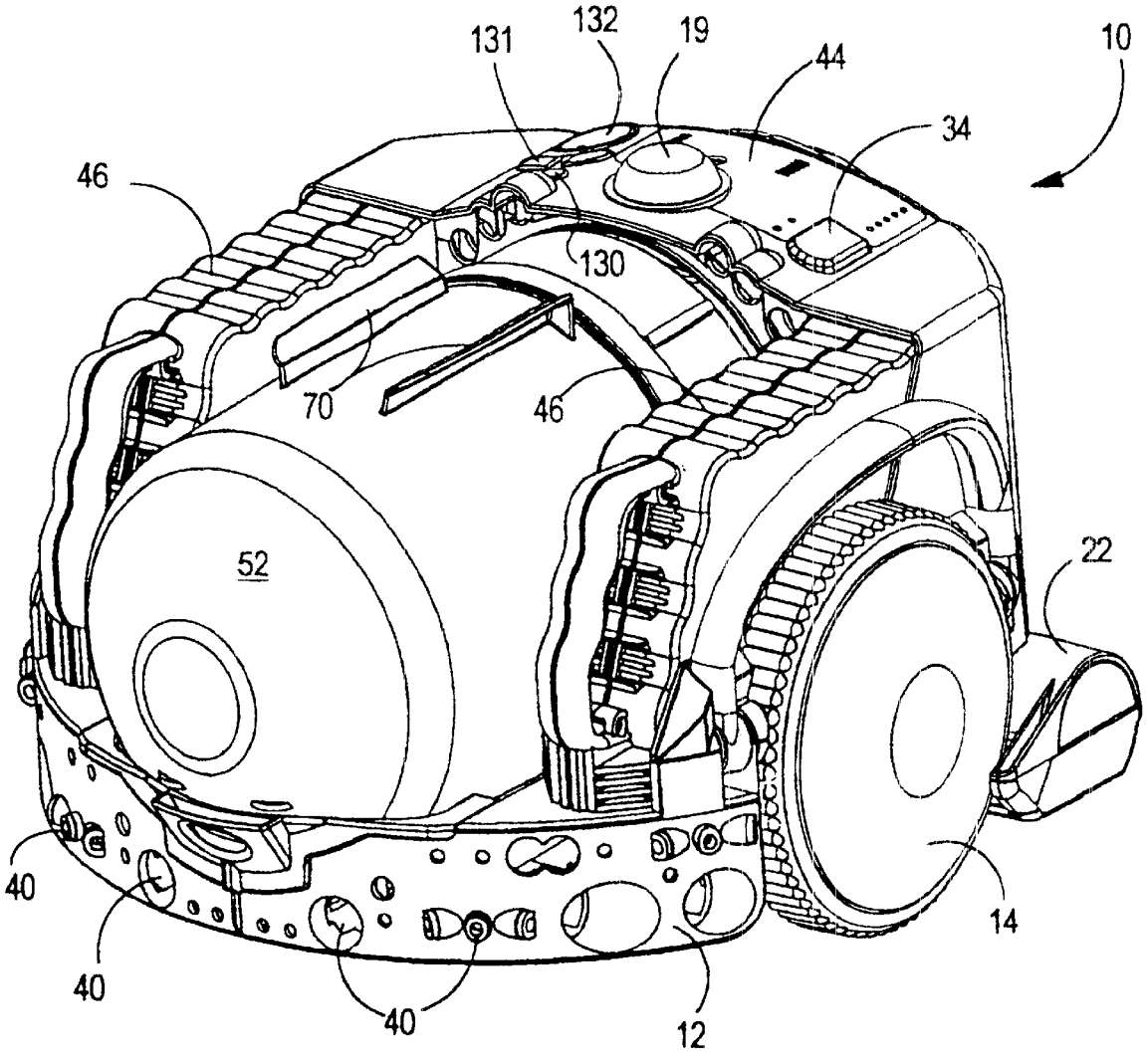
FIG. 1 is a perspective view of a vacuum cleaner according to the invention.

The vacuum cleaner 10 shown in the drawings has a supporting chassis 12 which is generally circular in shape and is supported on two driven wheels 14 and a castor wheel 16. The chassis 12 is preferably manufactured from high-strength moulded plastics material, such as ABS, but can equally be made from metal such as aluminium or steel. The chassis 12 provides support for the components of the cleaner 10 which will be described below. The driven wheels 14 are arranged at either end of a diameter of the chassis 12, the diameter lying perpendicular to the longitudinal axis 18 of the cleaner 10. Each driven wheel 14 is moulded from a high-strength plastics material and carries a comparatively soft, ridged band around its circumference to enhance the grip of the wheel 14 when the cleaner 10 is traversing a smooth floor. The driven wheels 14 are mounted independently of one another via support bearings (not shown) and each driven wheel 14 is connected directly to a motor 15 which is capable of driving the respective wheel 14 in either a forward direction or a reverse direction. By driving both wheels 14 forward at the same speed, the cleaner 10 can be driven in a forward direction. By driving both wheels 14 in a reverse direction at the same speed, the cleaner 10 can be driven in a backward direction. By driving the wheels 14 in opposite directions, the cleaner 10 can be made to rotate about its own central axis so as to effect a turning manoeuvre. The aforementioned method of driving a vehicle is well known and will not therefore be described any further here.

Figure 3:
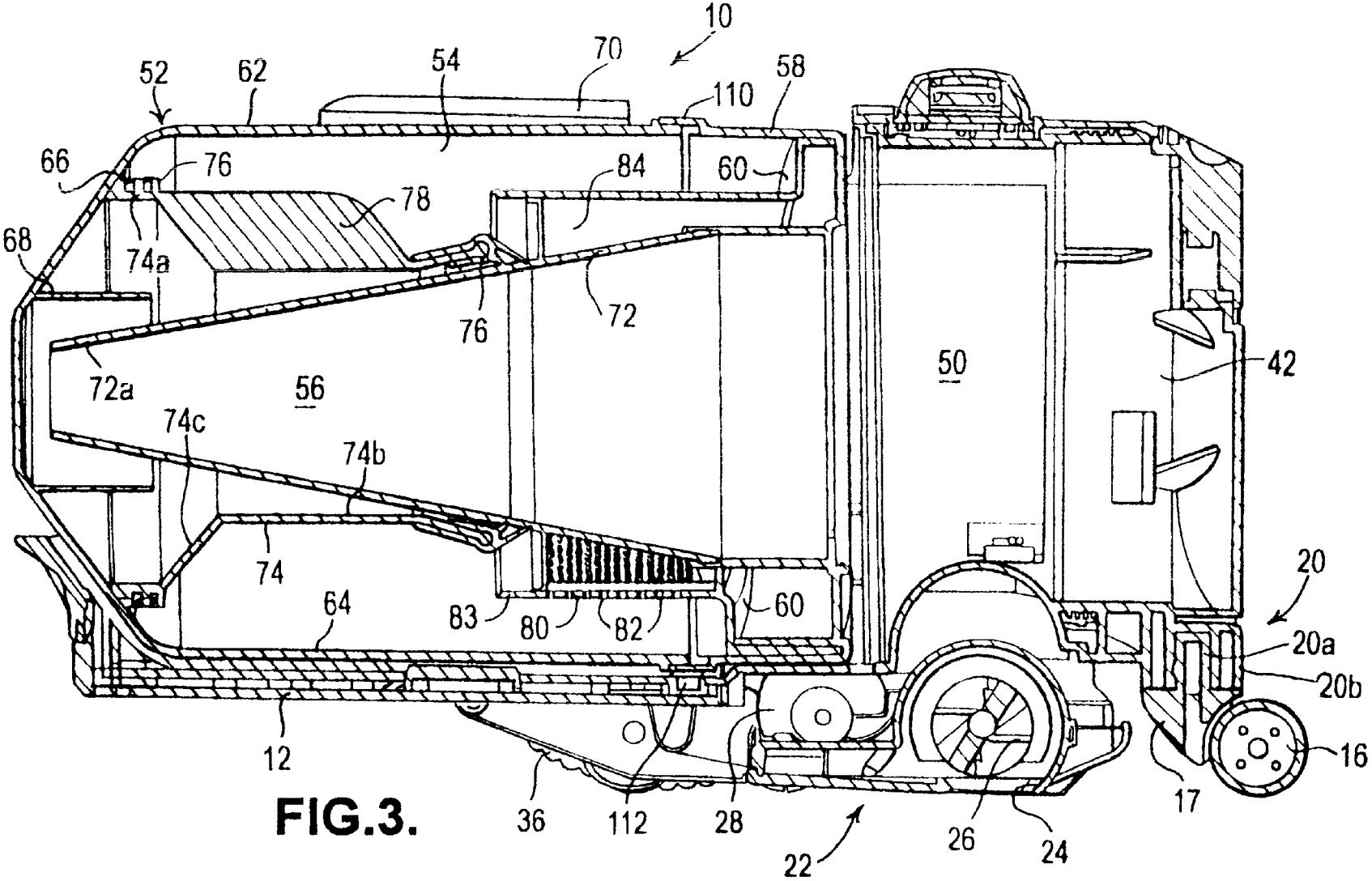
FIG. 3 is a sectional view through the vacuum cleaner of FIG. 1 taken along the line III—III of FIG. 2.

The castor wheel 16 is significantly smaller in diameter than the driven wheels 14 as can be seen from, for example, FIG. 3. The castor wheel 16 is not driven and merely serves to support the chassis 12 at the rear of the cleaner 10. The location of the castor wheel 16 at the trailing edge of the chassis 12, and the fact that the castor wheel 16 is swivellingly mounted on the chassis by means of a swivel joint 20, allows the castor wheel 16 to trail behind the cleaner 10 in a manner which does not hinder the manoeuvrability of the cleaner 10 whilst it is being driven by way of the driven wheels 14. The swivel joint 20 is most clearly shown in FIG. 3. The castor wheel 16 is fixedly attached to an upwardly extending cylindrical member 20*a* which is received by an annular housing 20*b* to allow free rotational movement of the cylindrical member 20*a* therewithin. This type of arrangement is well known. The castor wheel 16 can be made from a moulded plastics material or can be formed from another synthetic material such as Nylon.

Figure 4A:
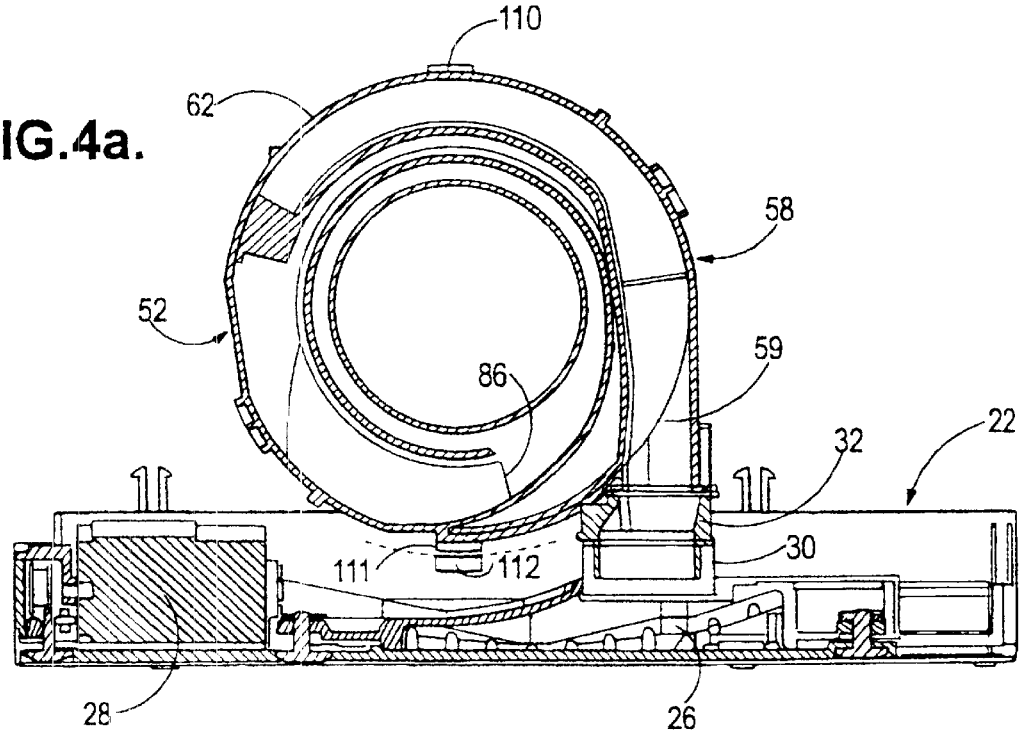
FIG. 4*a* is a transverse sectional view through part of the cleaner of FIG. 1 showing the separating apparatus in a first position.

Mounted on the underside of the chassis 12 is a cleaner head 22 which includes a suction opening 24 facing the surface on which the cleaner 10 is supported. The suction opening 24 is essentially rectangular and extends across the majority of the width of the cleaner head 22. A brush bar 26 is rotatably mounted in the suction opening 24 and a motor 28 is mounted on the cleaner head 22 for driving the brush bar 26 by way of a drive belt (not shown) extending between a shaft of the motor 28 and the brush bar 26. The cleaner head 22 is mounted on the chassis 12 in such a way that the cleaner head 22 is able to float on the surface to be cleaned. This is achieved in this embodiment in that the cleaner head 22 is pivotally connected to an arm 27 about a first pivot 29*a* (see FIG. 5) which in turn is pivotally connected to the underside of the chassis 12 about a second pivot 29*b* (chassis 12 is not shown in FIG. 5 for the sake of clarity). The double articulation of the connection between the cleaner head 22 and the chassis 12 allows the cleaner head 22 to move freely in a vertical direction with respect to the chassis 12. This enables the cleaner head 22 to climb over small obstacles such as books, magazines, rug edges, etc. Obstacles of up to approximately 25 mm in height can be traversed in this way. A flexible connection 30 (see FIGS. 4 and 5) is located between a rear portion of the cleaner head 22 and an inlet port 32 located in the chassis 12. The flexible connection 30 consists of a rolling seal, one end of which is sealingly attached to the upstream mouth of the inlet port 32 and the other end of which is sealingly attached to the periphery of an aperture in the cleaner head 22. When the cleaner head 22 moves upwardly with respect to the chassis 12, the rolling seal 30 distorts or crumples to accommodate the upward movement of the cleaner head 22. When the cleaner head 22 moves downwardly with respect to the chassis 12, the rolling seal 30 unfolds or extends into an extended position to accommodate the downward movement.

In order to assist the cleaner head 22 to move vertically upwards when an obstacle is encountered, forwardly projecting ramps 36 are provided at the front edge of the cleaner head 22. In the event that an obstacle is encountered, the obstacle will initially abut against the ramps 36 and the inclination of the ramps will then lift the cleaner head 22 over the obstacle in question so as to avoid the cleaner 10 from becoming lodged against the obstacle. The cleaner head 22 is shown in a lowered position in FIGS. 3 and 5. The castor wheel 16 also includes a ramped portion 17 which provides additional assistance when the cleaner 10 encounters an obstacle and is required to climb over it. In this way, the castor wheel 16 will not become lodged against the obstacle after the cleaner head 22 has climbed over it.

Figure 2:
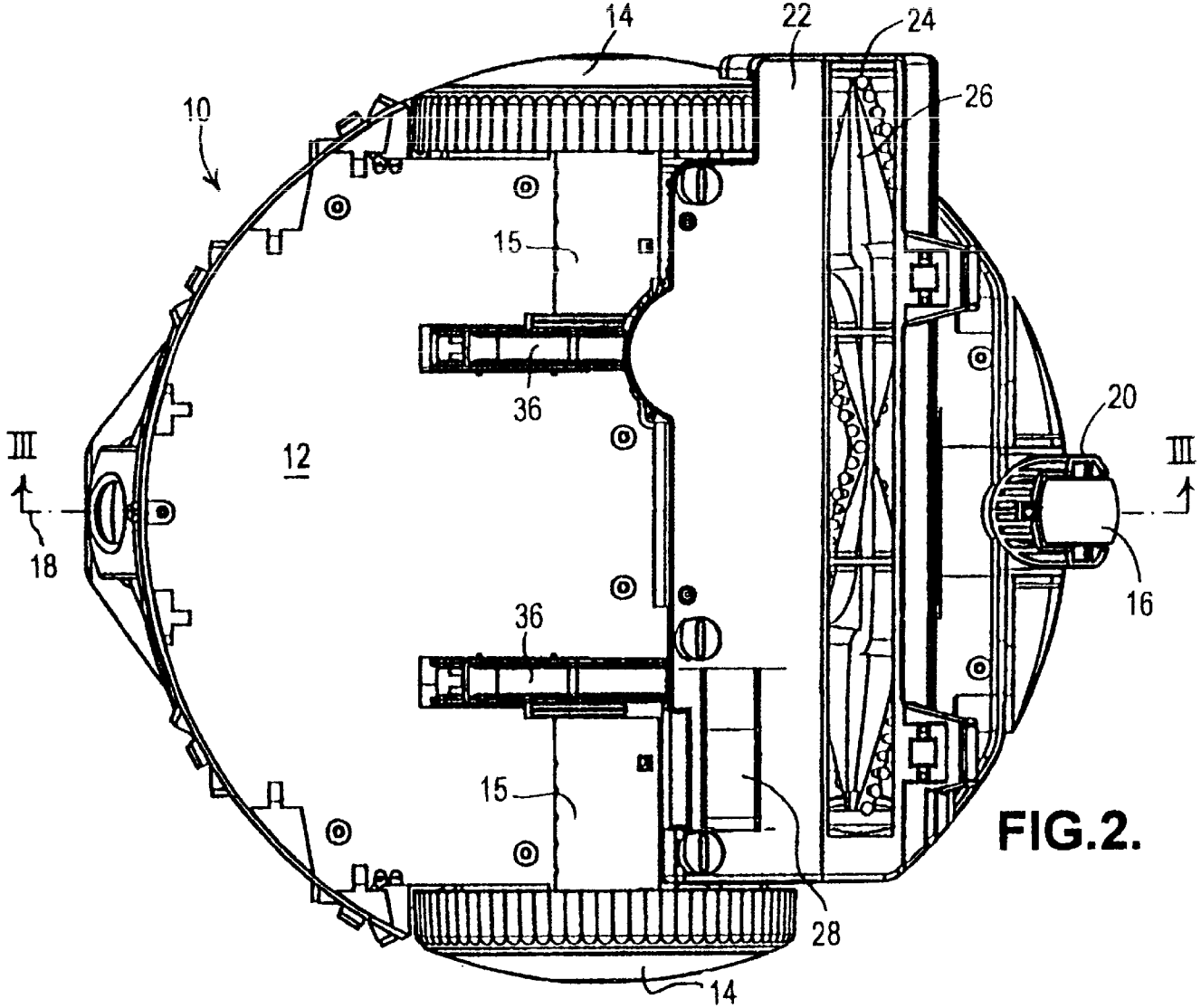
FIG. 2 is an underneath view of the vacuum cleaner of FIG. 1.

As can be seen from FIG. 2, the cleaner head 22 is asymmetrically mounted on the chassis 12 so that one side of the cleaner head 22 protrudes beyond the general circumference of the chassis 12. This allows the cleaner 10 to clean up to the edge of a room on the side of the cleaner 10 on which the cleaner head 22 protrudes.

The chassis 12 carries a plurality of sensors 40 which are designed and arranged to detect obstacles in the path of the cleaner 10 and its proximity to, for example, a wall or other boundary such as a piece of furniture. The sensors 40 comprise several ultra-sonic sensors and several infra-red sensors. The array illustrated in FIG. 1 is not intended to be limitative and the arrangement of the sensors does not form part of the present invention. Suffice it to say that the vacuum cleaner 10 carries sufficient sensors and detectors 40 to enable the cleaner 10 to guide itself or to be guided around a predefined area so that the said area can be cleaned. Control software, comprising navigation controls and steering devices, is housed within a housing 42 located beneath a control panel 44 or elsewhere within the cleaner 10. Battery packs 46 are mounted on the chassis 12 inwardly of the driven wheels 14 to provide power to the motors for driving the wheels 14 and to the control software. The battery packs 46 are removable to allow them to be transferred to a battery charger (not shown). The vacuum cleaner 10 also includes a motor and fan unit 50 supported on the chassis 12 for drawing dirty air into the vacuum cleaner 10 via the suction opening 24 in the cleaner head 22.

The chassis 12 also carries a cyclonic separator 52 for separating dirt and dust from the air drawn into the cleaner 10. The features of the cyclonic separator 52 are best seen from FIGS. 3 and 4. The cyclonic separator 52 comprises an outer cyclone 54 and an inner cyclone 56 arranged concentrically therewith, both cyclones 54, 56 having their coaxial axes lying horizontally. The cyclonic separator 52 comprises an end portion 58 which has a tangential inlet 59. The tangential inlet 59 has a mouth at the distal end thereof. The mouth is generally circular in shape, but is somewhat flattened along one edge to give the mouth a vaguely D-shaped section. The end portion 58 is otherwise generally cylindrical and has an end wall 60 which is generally helical. The end portion 58 opens directly into a cylindrical bin 62 having an outer wall 64 whose diameter is the same as that of the end portion 58. The end portion 58 and the cylindrical bin 62 are held together or joined by way of a releasable clip which can be of any known design. No specific clip is shown in the drawings. A lip seal is provided between the cylindrical bin 62 and the end portion 52 in order to maintain a good seal between the respective parts. The cylindrical bin 62 is made from a transparent plastics material to allow a user to view the interior of the outer cyclone 54. The end of the bin 62 remote from the end portion 58 is frusto-conical in shape and closed. A locating ring 66 is formed integrally with the end of the bin at a distance from the outer wall 64 thereof and a dust ring 68 is also formed integrally with the end of the 62 inwardly of the locating ring 66. Located on the outer surface of the bin 62 are two opposed gripper portions 70 which are adapted to assist a user to remove the separator 52 from the chassis 12 for emptying purposes. Specifically, the gripper portions 70 are moulded integrally with the transparent bin 62 and extend upwardly and outwardly from the outer wall 64 so as to form an undercut profile as shown in FIG. 1.

The inner cyclone 56 is formed by a partially-cylindrical, partially-frusto-conical cyclone body 72 which is rigidly attached to the end face of the end portion 58. The cyclone body 72 lies along the longitudinal axis of the transparent bin 62 and extends almost to the end face thereof so that the distal end 72*a* of the cyclone body 72 is surrounded by the dust ring 68. The gap between the cone opening at the distal end 72*a* of the cyclone body 72 and the end face of the bin 62 is preferably less than 8 mm.

A fine dust collector 74 is located in the bin 62 and is supported by the locating ring 66 at one end thereof. The fine dust collector 74 is supported at the other end thereof by the cyclone body 72. Seals 76 are provided between the fine dust collector 74 and the respective support at either end. The fine dust collector 74 has a first cylindrical portion 74*a* adapted to be received within the locating ring 66, and a second cylindrical portion 74*b* having a smaller diameter than the first cylindrical portion 74*a*. The cylindrical portions 74*a*, 74*b* are joined by a frusto-conical portion 74*c* which is integrally moulded therewith. A single fin or baffle 78 is also moulded integrally with the fine dust collector 74 and extends radially outwardly from the second cylindrical portion 74*b* and from the frusto-conical portion 74*c*. The outer edge of the fin 78 is aligned with the first cylindrical portion 74*a* and the edge of the fin 78 remote from the first cylindrical portion 74*a* is essentially parallel to the frusto-conical portion 74*c*. The fin 78 extends vertically upwardly from the fine dust collector 74.

A shroud 80 is located between the first and second cyclones 54, 56. The shroud 80 is cylindrical in shape and is supported at one end by the end portion 58 and by the cyclone body 72 of the inner cyclone 56 at the other end. As is known, the shroud 80 has perforations 82 extending therethrough and a lip 83 projecting from the end of the shroud 80 remote from the end portion 58. A channel 84 is formed between the shroud 80 and the outer surface of the cyclone body 72, which channel 84 communicates with an inlet port 86 leading to the interior of the inner cyclone 56 in a manner which encourages the incoming airflow to adopt a swirling, helical path. This is achieved by means of a tangential or scroll entry into the inner cyclone 56 as can be seen from FIG. 4. A vortex finder (not shown) is mounted on the housing of the motor and fan unit 50 and extends into the second cyclone 56 through an aperture in the end wall 60 of the end portion 58. The vortex finder is located centrally of the larger end of the inner cyclone 56 to conduct air out of the cyclonic separator 52 after separation has taken place. It also helps to secure the cyclonic separator 52 in position on the chassis 12.

The exiting air is conducted past the motor and fan unit 50 so that the motor can be cooled before the air is expelled to atmosphere. Additionally, a post-motor filter (not shown) can be provided downstream of the motor and fan unit 50 in order to further minimise the risk of emissions into the atmosphere from the vacuum cleaner 10.

Figure 5A:
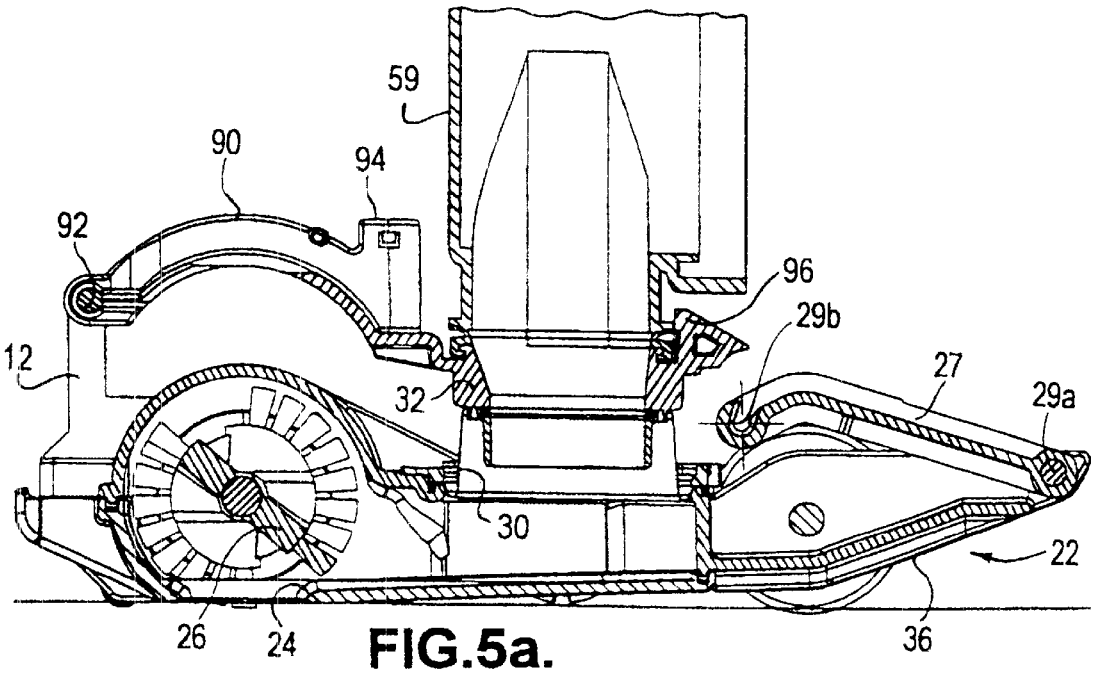
FIG. 5*a* is a longitudinal sectional view through part of the cleaner of FIG. 1 showing the separating apparatus connected to the chassis.
Figure 5B:
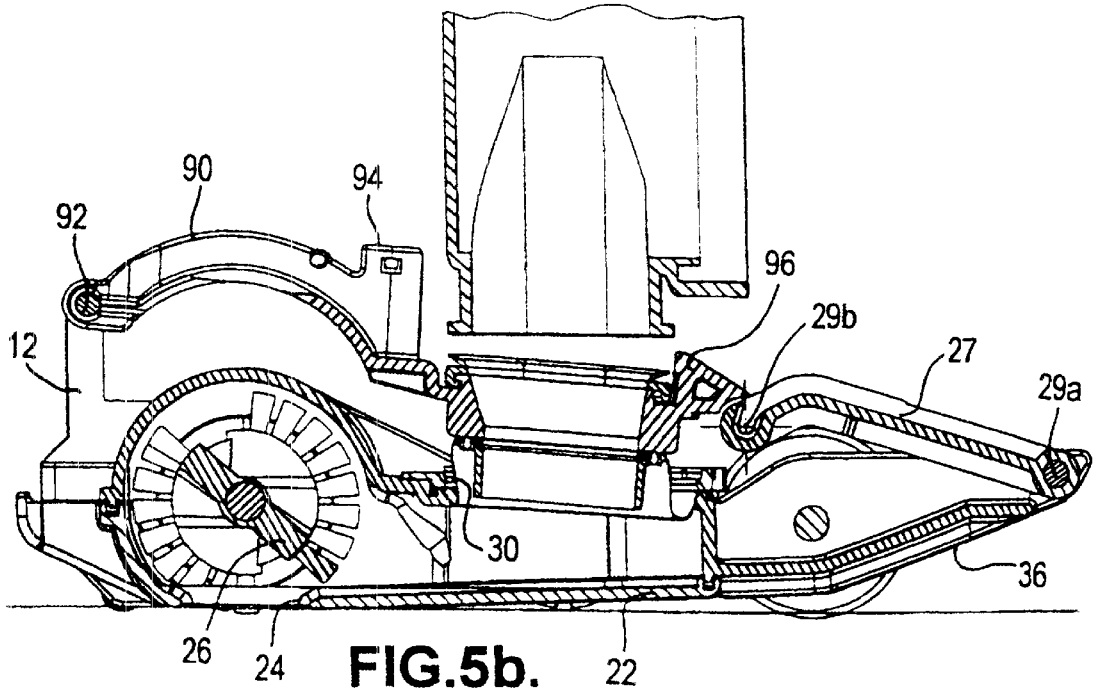
FIG. 5*b* is a longitudinal sectional view through part of the cleaner of FIG. 1 showing the separating apparatus being released from the chassis.

The entire cyclonic separator 52 is releasable from the chassis 12. A seal arm 90 is pivotally mounted about a pivot point 92 on the chassis 12. The seal arm 90 carries the inlet port 32 which, as described above, communicates with the cleaner head 22 by means of the rolling seal 30. The seal arm 90 is biased into an upward position (i.e., in a counterclockwise direction as seen in FIGS. 5*a* and 5*b*) by means of a spring (not shown) acting between a seat 94 of the seal arm 90 and a fixed part of the chassis 12. When the cyclonic separator 52 is located in the position shown in FIG. 5*a*, the inlet port 32 is pressed against the mouth of the tangential inlet 59 of the end portion 58 to form a seal therewith so that air can flow from the cleaner head 22 directly into the outer cyclone 54. A hooked catch 96 is provided on the seal arm 90 adjacent the inlet port 32 and on the side thereof remote from the motor and fan unit 50. The cyclonic separator 52 is held in position by means of the hooked catch 96 (in conjunction with the location of the vortex finder in the aperture in the end wall of the end portion) when the cleaner 10 is in use, as shown in FIG. 5*a*. A button 34 located in the control panel 44 is connected by a rod (not shown) to the seal arm 90 so that pressing the button 34 causes the seal arm 90 to move in a clockwise direction (as seen in FIG. 5) against the bias of the spring. The hooked catch 96 is then released from the mouth of the tangential inlet 59 so that the cyclonic separator 52 can be lifted away from the chassis 12 by means of the gripper portions 70. The bag 62 can then be released from the end portion 58 (which carries with it the shroud 80 and the inner cyclone body 72) to facilitate the emptying thereof.

When the bin 62 is released from the end portion 58, the user has the option to replace the two parts together in a different configuration. Instead of locating the end portion 58 on the bin 62 so at the tangential inlet 59 extends downwardly towards the inlet port 32, the end portion 58 can be turned through 180° so that the tangential inlet 59 extends vertically upwardly. The two positions of the end portion 58 with respect to the bin 62 are diametrically opposed. Shapings (not shown) can be moulded into the bin 62 and end portion 58 in order to avoid the relevant pars being joined together in other configurations. The execution of the rotation of the end portion 58 with respect to the bin 62 is easily carried out by first separating the two parts, re-orienting them and then joining them in the appropriate manner.

Figure 4C:
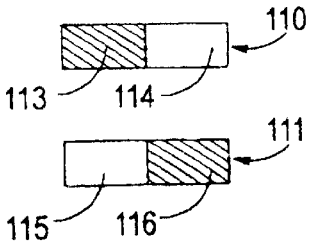
FIG. 4*c* shows labels of different reflectivities used on end portions of the cleaner of FIG. 1.
Figure 4B:
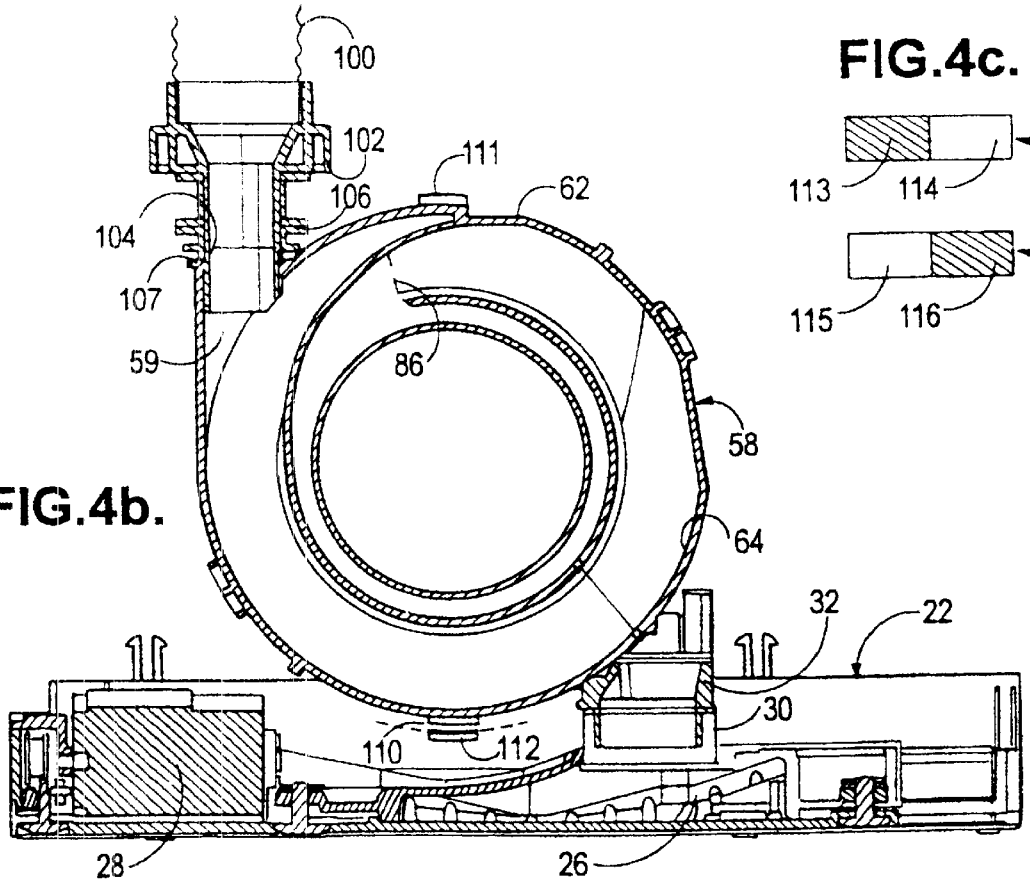
FIG. 4*b* is a transverse sectional view through part of the cleaner of FIG. 1 showing the separating apparatus in a second position.

When the end portion 58 has been rotated with respect to the bin 62 as described above, the tangential inlet 59 will then extend vertically upwardly. This exposes the tangential inlet 59 as shown in FIG. 4*b* so that a hose or a hose and wand assembly can be attached directly to the tangential inlet 59. The hose 100 has a connector 102 which comprises a tubular conduit 104 which is dimensioned so as to fit snugly inside the tangential inlet 59, and a flange 106 which extends outwardly from the conduit 104. The flange 106 carries a seal 107 which, when the connector 102 is introduced to the tangential inlet 59, abuts against the mouth of the tangential inlet 59. When the hose 100 is fitted to the tangential inlet 59, the operation of the motor and fan unit 50 draws air into the cleaner 10 via the hose 100 instead of via the cleaner head 22. The hose or hose and wand assembly can then be used to clean areas of the carpet or other surface to be cleaned which cannot be reached by the cleaner when it is operating in a robotic mode; for example, when small or narrow areas need to be accessed.

The vacuum cleaner 10 described above operates in the following manner in a robotic mode. In order for the cleaner 10 to traverse the area to be cleaned, the wheels 14 are driven by the motors 15 which, in turn, are powered by the batteries 46. The direction of movement of the cleaner 10 is determined by the control software which communicates with the sensors 40 which are designed to detect any obstacles in the path of the cleaner 10 so as to navigate the cleaner 10 around the area to be cleaned. Methodologies and control systems for navigating a robotic vacuum cleaner around a room or other area are well documented elsewhere and do not form part of the inventive concept of this invention. Any of the known methodologies or systems could be implemented here to provide a suitable navigation system.

The batteries 46 also provide power to operate the motor and fan unit 50 to draw air into the cleaner 10 via the suction opening 24 in the cleaner head 22. The end portion 58 is orientated so that the tangential inlet 59 to the outer cyclone 56 communicates with the cleaner head 22. The motor 28 is also driven by the batteries 46 so that the brush bar 26 is rotated in order to achieve good pick-up, particularly when the cleaner 10 is to be used to clean a carpet. The dirty air is drawn into the cleaner head 22 and conducted to the cyclonic separator 52 via the telescopic conduit 30 and the inlet port 32. The dirty air then enters the end portion 58 in a tangential manner and adopts a helical path by virtue of the shape of the end wall 60. The air then spirals down the interior of the outer wall 64 of the bin 62 during which motion any relatively large dirt and fluff particles are separated from the airflow. The separated dirt and fluff particles collect in the end of the bin 62 remote from the end portion 58. The fin 78 discourages uneven accumulation of dirt and fluff particles and helps to distribute the dirt and fluff collected around the end of the bin 62 in a relatively even manner.

The airflow from which dirt and larger fluff particles has been separated moves inwardly away from the outer wall 64 of the bin 62 and travels back along the exterior wall of the fine dust collector 74 towards the shroud 80. The presence of the shroud 80 also helps to prevent larger particles and fluff traveling from the outer cyclone 54 into the inner cyclone 56, as is known. The air from which comparatively large particles and dirt has been separated then passes through the shroud 80 and travels along the channel between the shroud 80 and the outer surface of the inner cyclone body 72 until it reaches the inlet port 86 to the inner cyclone 56. The air then enters the inner cyclone 56 in a helical manner and follows a spiral path around the inner surface of the cyclone body 72. Because of the frusto-conical shape of the cyclone body 72, the speed of the airflow increases to very high values at which the fine dirt and dust still entrained within the airflow is separated therefrom. The fine dirt and dust separated in the inner cyclone 56 is collected in the fine dust collector 74 outwardly of the dust ring 68. The dust ring 68 discourages re-entrainment of the separated dirt and dust back into the airflow.

When the fine dirt and dust has been separated from the airflow, the cleaned air exits the cyclonic separator via the vortex finder (not shown). The air is passed over or around the motor and fan unit 50 in order to cool the motor before it is expelled into the atmosphere. When a hose or hose and wand assembly is to be used to clean other areas, the cyclonic separator 52 is released from the chassis 12 and the end portion 58 is moved to the orientation in which the tangential inlet 59 is exposed so that the hose 100 can be attached. The cyclonic separator is then replaced on the chassis 12 and the hose is attached to the inlet 59. The motor and fan unit 50 is then switched on and cleaning recommences. The cyclonic separator 52 is also released from the chassis 12 when the bin 62 requires to be emptied.

A user rotates the end portion 58, and thereby the tangential inlet 59, into the appropriate position, depending on whether they wish cleaning to be achieved by the cleaner head 22 (auto mode) or manually by a hose 100 (hose mode). The cleaner automatically senses the position of the tangential inlet 59 and responds according to the sensed position. There are a variety of ways in which the position of the end portion 58 can be sensed. Referring again to FIGS. 4*a* and 4*b*, these show an optical sensing arrangement comprising an optical source, such as an infra-red source, and detector 112 mounted on the chassis of the cleaner compartment that underlies the end portion 58. This can also be seen in FIG. 3. The end portion 58 carries two labels 110, 111. The labels are mounted on the outer face of end portion 58 at positions such that they lie directly opposite the sensor 112 when the end portion has been properly inserted into the cleaner in either its auto mode position or hose mode position. The sensing arrangement works by illuminating the label 110,111 with the optical source 112 and sensing light reflected from the label 110,111. The labels are shown in FIG. 4*c*. Each of the labels 110,111 carries two portions of differing reflectivity; label 110 has a black (low reflectivity) portion 113 and a silver (high reflectivity) portion 114. Other colours could of course be used. Label 110 is mounted on the end portion 58 so that the order of black/silver portions 113,114 is reversed with respect to the black/silver portions 115,116 on label 111. Sensor 112 is arranged to monitor light reflected from one half of the label and therefore, due to the different ordering of the black/silver label portions, will receive differing amounts of light depending on whether label 110 or label 111 is adjacent the sensor 112 and provides an electrical signal to the control system of the cleaner.

FIGS. 6*a*–6*c* show an alternative arrangement for sensing, the position of end portion 58. Here, the position of the end portion 58 is sensed mechanically. Instead of the labels 110,111 and optical sensor 112, a microswitch 120 is mounted on the chassis 12 of the cleaner adjacent where locating ribs of the end portion 58 lie. Two locating ribs 121,122 on the outer face of end portion 58 are diferently formed: rib 121 (seen more clearly in FIG. 6*c*) is solid whereas rib 122 has an indentation. When the end portion is fitted to the cleaner chassis, solid rib 121 causes operating member 123 of microswitch 120 to remain retracted within the switch casing, whereas indented rib 122 allows operating member 123 to project in to the indentation. The microswitch 120 responds differently under these two situations, and provides an electrical signal to the control system of the cleaner. It will be appreciated that the microswitch can be mounted in other positions and can respond to other mechanical features of the end portion 58. For example, it may be preferable to have the indentation part-way along the longitudinal axis of locating rib 122, i.e. directed into the paper in FIGS. 6*a* and 6*b*.

As a further alternative to the optical or mechanical sensing arrangements described, an electrical sensing arrangement can be used. A conductive strip is placed on one side of the end portion 58, in place of the reflective label 110, and a pair of contacts are located on the chassis 12 in place of the optical sensor 112. In one position of the end portion 58, the contacts will be electrically coupled by the conductive strip so that a current can flow between the contacts, and in the other position of the end portion 58 the contacts will be separated by the electrically insulating plastic casing of the end portion 58 so that a current cannot flow.

Figure 7:
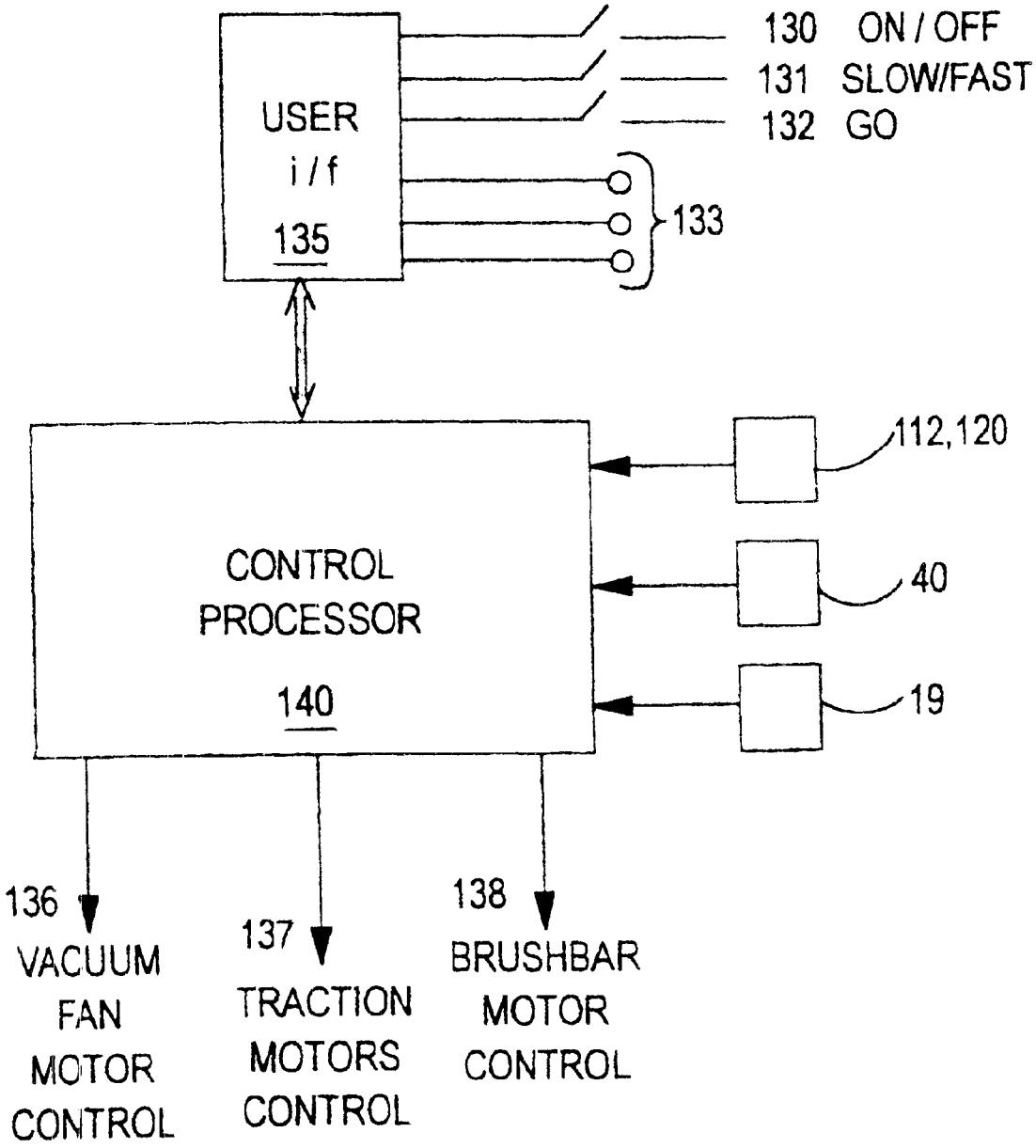
FIG. 7 is a block diagram of a control system for the cleaner of FIG. 1.

FIG. 7 shows part of the control system for the cleaner. A central processor 140, such as a Hitachi H8/3334 microprocessor, is connected to a user interface board 135. A user can control the cleaner using switches 130,131,132, which generate inputs to the processor 140, and the processor 140 generates output signals for illuminating lights 133 to signal warning conditions and the mode of operation to the user. Processor 140 also receives inputs from sensors 19, 40 which are used for navigation and from sensor 112,120 which senses the position of the inlet 59. Processor 140 also generates control signal outputs for controlling parts of the cleaner. For simplicity, only the control signals that are relevant to this application are shown.

The user controls the cleaner 10 through interaction with the control switches 130, 131 and 132. Switch 130 is a global ON/OFF switch which interacts directly with the processor 140. Setting the switch 130 to ON activates the processor 140 which then executes a power up sequence. Switches 131 select slow or fast forward operation for the autonomous mode of the cleaner, and switch 132 is a go/pause button.

Figure 8:
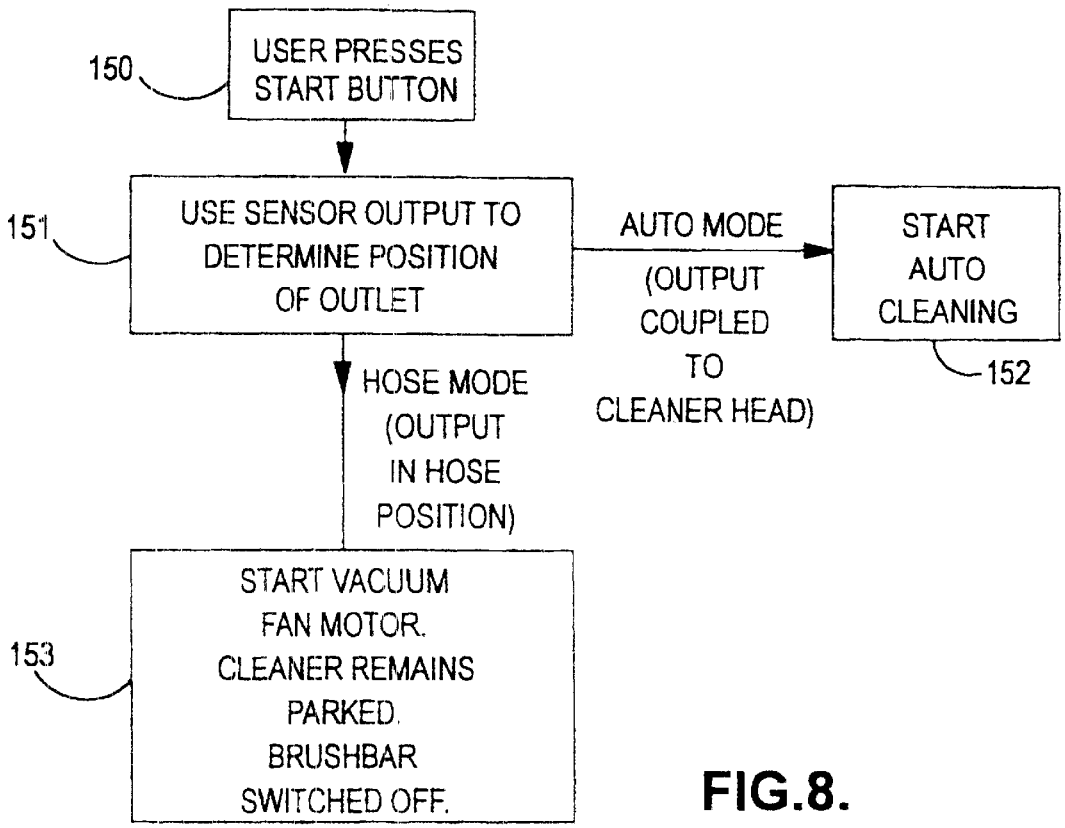
FIG. 8 is a flow diagram of a method of operating the cleaner which can be performed by the control system of FIG. 7.

FIG. 8 shows a method performed by control processor 140 to control operation of the cleaner. When a user presses the ON/OFF switch 130, the control processor 140 monitors the output of the end portion 58 sensor, which will be the optical sensor 112 or microswitch 120. The control processor compares the monitored output of the sensor with stored data representing expected sensor outputs for the two positions of the end portion 58 (step 151, FIG. 8) and selects the appropriate mode of operation according to the sensed position of inlet 59—hose mode for inlet 59 in the upwardly pointing position (FIG. 4*a*) and auto mode for the inlet 59 in the downwardly pointing position (FIG. 4*b*.) When the user presses the 'GO' switch 132 and hose mode has been selected, the control processor 140 issues control outputs to start the vacuum fan motor (output 136, FIG. 7) but to inhibit the brush bar (outputs 137, 138, FIG. 7.) The control processor 140 can also output a signal to user interface 135 to light an appropriate indicator lamp 133 indicating hose mode operation. During hose mode operation the control processor 140 does not need to operate its navigation system.

For autonomous mode operation, the control processor 140 issues control outputs to control use of the vacuum fan motor (output 136, FIG. 7), the traction motors and the brush bar (outputs 137, 138, FIG. 7.) The control processor 140 also outputs a signal to user interface 135 to light an appropriate indicator lamp 133 indicating autonomous operation. During autonomous mode, the control processor 140 receives inputs from the exterior sensors 19, 40 and uses this information to navigate around an arm The invention is not intended to be limited to the precise details of the embodiment described above. Most importantly, the invention is not to be regarded as applicable only to vacuum cleaners with cyclonic separators or which are robotic in nature, although the specific example described above indicates that the invention has application in these areas. The cyclonic separator illustrated in the drawings could be replaced by a bag filter with a shell or part-shell surrounding it in order to give it some structure, or by a bag filter merely fitted with a rigid inlet which would then be attachable to the cleaner head in one configuration and to a clip or holder to allow a hose to be attached in another configuration. It is also envisaged that the whole of the cyclonic separator shown in the drawings (or an equivalent non-cyclonic separator) could be rotatable or otherwise movable as a whole, i.e. the end portion is always connected to the bin in the same configuration but the whole cyclonic separator is rolled though 180°, in order to move the tangential inlet from the first position into the second position. This arrangement is also intended to be included within the scope of the invention along with arrangements in which the cyclonic separator, or the part incorporating the inlet, is rolled through other angles, such as 90°, between the first and second positions. The invention is, of course, applicable to any type of vacuum cleaner which requires to be converted between a first mode in which the dirty air is drawn in though a cleaner head and a second mode in which the dirty air is drawn in rough a hose. It will be appreciated from the above description that the means by which the cleaner is propelled across the surface to be cleaned, the means by which the cleaner head is attached to the chassis, the means by which the cleaner (if it is robotic) senses and avoids obstacles and other nonessential features are all immaterial to the present invention.

Figure 9:
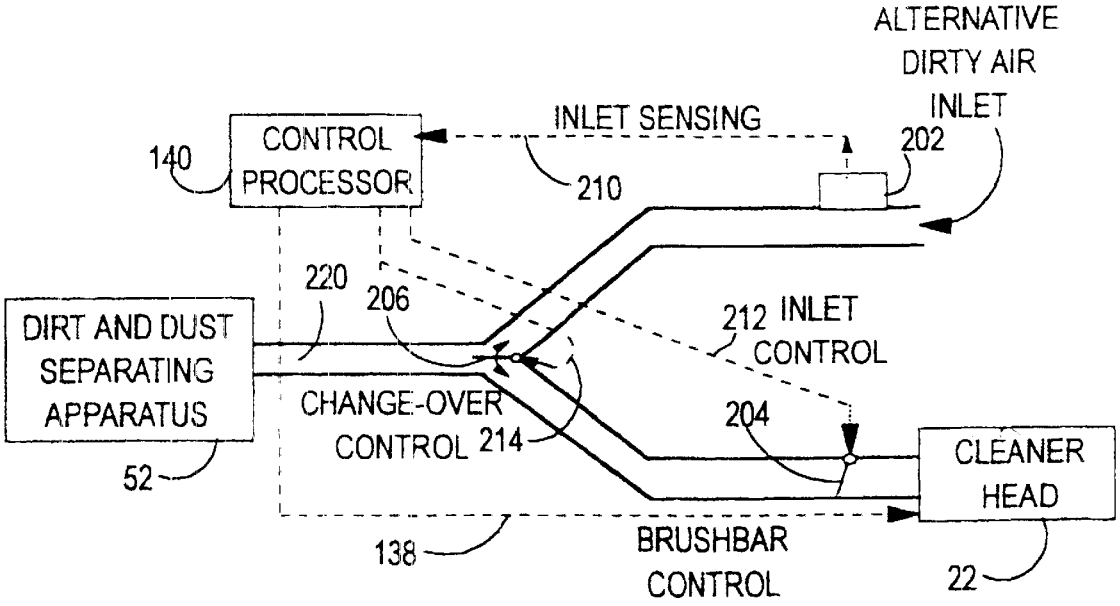
FIG. 9 is a block diagram of an arrangement for controlling operation of the cleaner head according to whether the cleaner head or an alternative dirty air inlet is being used.

An alternative aspect of the invention controls operation of the agitating device within the cleaner head according to whether the cleaner head or the alternative dirty air inlet is being used. For this aspect of the invention, the inlet of the dirt and dust separating apparatus, or the entire dirt and dust separating apparatus incorporating the inlet, may be movable between two positions. Alternatively, the dirt and dust separating apparatus can have two inlets: a first inlet from the cleaner head, and a second inlet from an alternative dirty air inlet. FIG. 9 shows this alternative form. Dirt and dust separating apparatus 52 has inlet ducting 220 which can receive dirty air from the cleaner head 22 or an alternative dirty air inlet. A sensor 202 at the alternative dirty air inlet senses the presence of a hose at the inlet and supplies a sensing signal 210 indicative of the presence of a hose at the inlet or of a cover to the alternative inlet being moved to insert a hose. In response to receiving inlet sensing signal 210, the control processor 140 issues a cleaner head inlet control signal 212 to control inlet valve 204, or an inlet changeover control signal 206 to operate changeover valve 206, to close one of the inlet paths such that the dirt and dust separating apparatus receives a dirty airflow from only one of the inlet paths. The control processor 140 also issues a brush bar control signal 138 to inhibit operation of the brush bar whenever the alternative dirty air inlet is being used. The cleaner head may have a brush bar or some other device to agitate the floor surface beneath the cleaner head 22.

What is claimed is:

1. A vacuum cleaner comprising a chassis releasably supporting a dirt and dust separating apparatus for separating dirt and dust from an airflow, and a cleaner head having an outlet communicating releasably with an inlet of the dirt and dust separating apparatus, the dirt and dust separating apparatus being releasable from the chassis to allow the dirt and dust separating apparatus, or a part thereof incorporating the inlet, to move into an alternative position in which the outlet of the cleaner head is not in communication with the inlet of the dirt and dust separating apparatus and in which an alternative dirty air outlet may be connected to the inlet of the dirt and dust separating apparatus.

2. The vacuum cleaner as claimed in claim 1, wherein the alternative dirty air outlet comprises a hose or a hose and wand assembly.

3. The vacuum cleaner as claimed in claim 1 or 2, wherein the dirt and dust separating apparatus comprises, or is surrounded by, a rigid shell or housing.

4. The vacuum cleaner as claimed in claim 3, wherein the rigid shell or housing is generally cylindrical in shape.

5. The vacuum cleaner as claimed in claim 3 or 4, wherein the rigid shell or housing comprises a removable portion which is attachable to the remainder of the rigid shell or housing in more than one position.

6. The vacuum cleaner as claimed in claim 3 or 4, wherein the rigid shell or housing has a main body and a removable end portion, the end portion being attachable to the main body in more than one position.

7. The vacuum cleaner as claimed in claim 6, wherein the end portion is attachable to the main body in two predetermined positions.

8. The vacuum cleaner as claimed in claim 7, wherein the predetermined positions are diametrically opposed.

9. The vacuum cleaner as claimed in claim 1, wherein the dirt and dust separating apparatus comprises a centrifugal separator.

10. The vacuum cleaner as claimed in claim 9, wherein the centrifugal separator comprises two cyclones arranged in series.

11. The vacuum cleaner as claimed in claim 9 or 10, wherein the centrifugal separator has a tangential inlet.

12. The vacuum cleaner as claimed in claim 9 or 10, wherein the part of the separating apparatus incorporating the inlet carries a cyclone body which fits within the remainder of the dirt and dust separating apparatus.

13. The vacuum cleaner as claimed in claim 1, wherein the outlet comprises a seal corresponding to the inlet.

14. The vacuum cleaner as claimed in claim 1, further comprising a hose or a hose and wand assembly having a connector portion adapted to be connected to the inlet of the dirt, and dust separating apparatus.

15. The vacuum cleaner as claimed in claim 14, wherein the connector portion carries a seal.

16. The vacuum cleaner as claimed in claim 1, further comprising means for sensing the position of the dirt and dust separating apparatus and for controlling operation of the cleaner according to the sensed position.

17. The vacuum cleaner as claimed in claim 1, further comprising means for sensing the position of the dirt and dust separating apparatus or the position of the part incorporating the inlet and for controlling operation of the cleaner according to the sensed position.

18. The vacuum cleaner as claimed in claim 17, wherein the cleaner is an autonomous cleaner which is capable of autonomously moving over an area, and wherein the sensed position of the part incorporating the inlet controls whether the cleaner operates in an autonomous mode or a manual mode.

19. The vacuum cleaner as claimed in claim 13 or 18, wherein, when the sensing means senses that the outlet of the cleaner head is not in communication with the inlet of the dirt and dust separation apparatus, operation of a brush bar on the cleaner head is inhibited.

20. An autonomous vacuum cleaning appliance, comprising dirt and dust separating apparatus for separating dirt and dust from an airflow, a cleaner head including an agitating device for agitating the floor surface to be cleaned, the dirt and dust separating apparatus being capable of communicating with airflow from an output of the cleaner head or airflow from an alternative dirty air outlet, and means for sensing when the alternative dirty air outlet is being used and for inhibiting operation of the agitating device during use of the alternative dirty air outlet, wherein the dirt and dust separating apparatus comprises a dirty air inlet which is movable between a first position in which it is in communication with the cleaner head and a second position in which it is in communication with the alternative dirty air outlet and wherein the sensing means senses the position of the dirty air inlet.

* * * * *

UNITED STATES PATENT AND TRADEMARK OFFICE

CERTIFICATE OF CORRECTION

PATENT NO. : 6,519,804 B1
DATED : February 18, 2003
INVENTOR(S) : Remco Douwinus Vuijk It is certified that error appears in the above-identified patent and that said Letters Patent is hereby corrected as shown below:

Title page,
Item [75], revise to read:
-- [75] Inventor: Remco Douwinus Vuijk, Bath (GB) --.

Column 11,
Lines 49-52, replace claim 5 with the following:

5. The vacuum cleaner as claimed in claim 4, wherein the rigid shell or housing comprises a removable portion which is attachable to the remainder of the rigid shell or housing in more than one position.

Lines 53-56, replace claim 6 with the following:

6. The vacuum cleaner is claimed in claim 4, wherein the rigid shell or housing has a main body and a removable end portion, the end portion being attachable to the main body in more than one position.

Signed and Sealed this

Twenty-second Day of July, 2003

JAMES E. ROGAN
*Director of the United States Patent and Trademark Office*